US005101214A

United States Patent [19]

Ohtsuka et al.

[11] Patent Number: 5,101,214

[45] Date of Patent: Mar. 31, 1992

[54] ADJUSTABLE LENGTH FOLDED DIPOLE ANTENNA

[75] Inventors: Sohzo Ohtsuka; Yasushi Matsuyama; Kazuki Hosoya, all of Tokyo, Japan

[73] Assignee: Tomy Company, Ltd., Tokyo, Japan

[21] Appl. No.: 565,676

[22] Filed: Aug. 10, 1990

[30] Foreign Application Priority Data

Aug. 29, 1989 [JP] Japan ..... 1-222507

[51] Int. Cl.[5] ..... H01Q 9/26

[52] U.S. Cl. ..... 343/803; 343/823; 343/877

[58] Field of Search ..... 343/823, 877, 803, 897, 343/795, 804; 242/54 A

[56] References Cited

U.S. PATENT DOCUMENTS 2,778,017 1/1957 Dorcsjak ..... 343/823
3,163,863 12/1964 Fujino ..... 343/823
3,299,431 1/1967 Hoblin ..... 343/823
3,624,657 11/1971 Kahn ..... 343/823
4,663,632 5/1987 Budrow et al. ..... 343/823
4,789,867 12/1988 Lee ..... 343/877

FOREIGN PATENT DOCUMENTS

2139817 A 11/1984 United Kingdom .

*Primary Examiner*—Michael C. Wimer
*Attorney, Agent, or Firm*—Staas & Halsey

[57] ABSTRACT

An antenna device includes a base, a metal band having two opposite ends, a reel disposed within the base and having one end of the band connected thereto for winding the band thereon, the opposite end of the band being received in the base, and a guide receives the band outside the base for forming the band into substantially horizontal and vertical components, and for adjusting the length of the horizontal and vertical components of the band.

14 Claims, 4 Drawing Sheets

ADJUSTABLE LENGTH FOLDED DIPOLE ANTENNA

BACKGROUND OF THE INVENTION

1. Field of the Invention

The present invention relates to an antenna device for UHF, VHF, FM etc., and having a base for extending and storing an antenna element.

2. Description of the Related Art

In general, it has been known to structure an antenna to be extendable (disclosed for example, Japanese Patent SHO 39(1964)-25826). This antenna will be explained with reference to FIG. 10 herein, where numerals 1 and 2 denote metal bands which are slightly arcuate in cross-section so as to be substantially rigid and straight under normal conditions. The metal band can be bent with a curvature when the sectional shape is flattened by a bending moment, and returns to its arcuate sectional shape to have a proper amount of flexibility and rigidity when the bending moment is removed. This type of metal band is commonly used for measuring tape devices. Numeral 3 is a guide piece having arms 4 and 5 extending diagonally upwardly on the upper portion thereof, and is provided with arms 6 and 7 in the lower portion thereof. The metal bands 1 and 2 have first ends fixedly connected to the arms 4 and 5 by screws 8 to extend diagonally upwardly. The bands form a curvature 9 at a certain lengthened position, extend vertically upward through the lower arms 6 and 7 and the inductive path formed in the guide piece, and have second ends connected to a movable control 10. In use, the metal band is extended and retracted by sliding the control 10 up and down to adjust the length of the projected portions extending diagonally upwardly by the sliding action. Therefore, the tuning frequency can be changed. The guide piece 3 is supported on a base 11.

The conventional device having the structure as described above, uses the process for adjusting the length of projected portion by moving upwardly or downwardly the control 10. Since the length of the metal band is already determined, the projected portion becomes smaller, but the vertical portion becomes contrary longer when the control 10 is moved upwardly for tuning in the radio wave having short wavelength, for example. In this case, since the antenna is fixed near to the earth in the electrical view, the adjustment of the height cannot be carried out. Further, when the radio wave having a short wavelength is tuned, it is difficult to keep the feeding point of the antenna at a certain amount because the vertical portion of the metal band acts as a trap circuit. Therefore, it causes a disadvantage that the electrical characteristic becomes unstable.

Further, when the vertical portion becomes longer, the center of gravity of whole antenna is at a higher position, thus causing the device to be unstable.

SUMMARY OF THE INVENTION

The present invention has been devised in view of the subject matter as described above, and an object of the invention is therefore to provide an antenna device having improved electrical characteristics, stability, and portable.

For solving the object as mentioned above, the present invention provides an antenna device having a base structured to adjust tuning frequency by expanding and contracting the length of a metal band with a proper amount of flexibility and rigidity having an arcuate section, which comprises a wind means for adjusting variable length portion of the metal band formed inside of the base.

When the antenna is out of use, the metal band is stored to be wound by the wind means in the base. On setting the antenna, the metal band is pulled from the base to form a horizontal element having a certain length. The variable length portion can be adjusted length-wise by winding the wind means.

These and other features and advantages of the antenna device of the present invention will become more apparent with reference to the following detailed description and drawings.

BRIEF DESCRIPTION OF THE DRAWINGS

FIG. 1(*a*) is a transverse sectional view of the metal band showing the arcuate shape thereof;

DETAILED DESCRIPTION OF THE PREFERRED EMBODIMENTS

Figure 1:
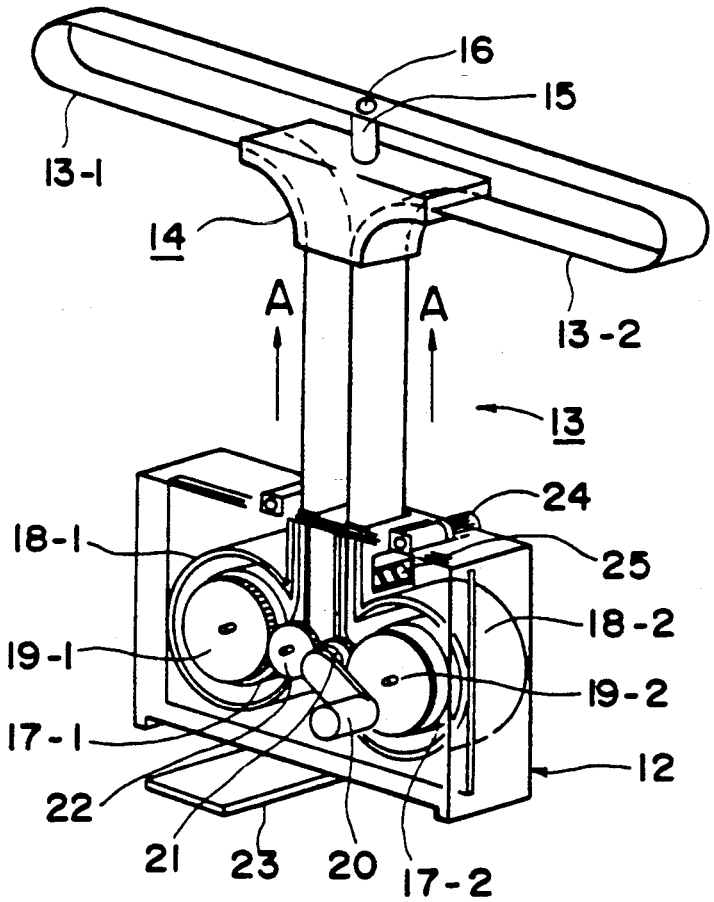
FIG. 1 is a perspective view, partially cut-away, showing a first preferred embodiment of the present invention.
Figure 1A:
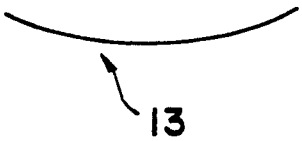
Figure 2:
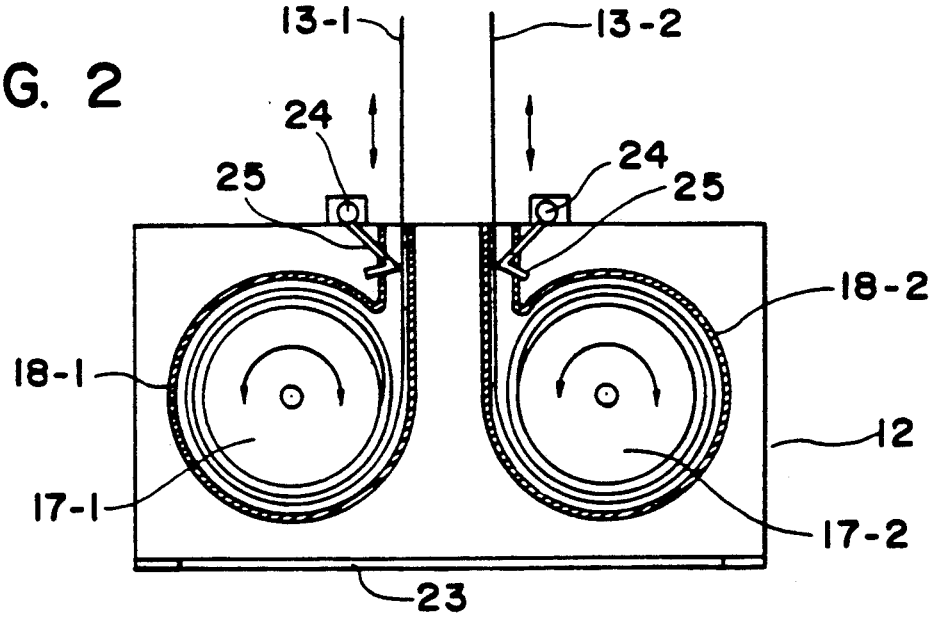
FIG. 2 is a side elevational view showing a winding mechanism of the embodiment of FIG. 1.

In FIG. 1, an antenna device includes a base 12 of generally rectangular box shape, and a metal band 13 which is stored to be wound in the base 12. A T-shaped guide 14 through which the band is directed has a spacer 15 upstanding from a center of an upper portion of the guide. The metal band 13 is fixedly connected to the spacer 15 by means of a screw 16 in its continuous intermediate portion. The portions 13-1 and 13-2 of the free end side of the band are inserted through the T-shaped guide 14 as shown by the dotted lines, and wound around drums 17-1 and 17-2 provided in the base 12. FIG. 2 is a view showing the main portion of the winding mechanism, and the numerals shown therein correspond to those of FIG. 1. Each drum is provided with a casing 18-1 and 18-2 on its circumference, the casings being used as guides for the metal band portions 13-1 and 13-2. Gears 19-1 and 19-2 are fixedly coupled to and rotatable with each corresponding drum. A gear 21 connected to a wind handle 20 and an idler gear 22 are provided between the gears 19-1 and 19-2 to engage each other. When the wind handle 20 is rotated in the clockwise direction, the drum 17-2 is rotated in the counter-clockwise direction to take up the metal band 13-2, while the drum 17-1 engaged with the idler gear 22 is rotated in the clockwise direction to take up the metal band 13-1 at the same side. A stabilizer plate 23 is mounted rotatably in the lower portion of the base 12 by means of a shaft (not shown), and is deployed by rotating 90° when the antenna is under operation. When not in use, the plate 23 is parallel to and recessed in a lower end of the base 12.

On the upper side of the base, a connection element 24 is provided, and a brush 25 integrated with the connection element is slidably contacted with the metal band 13-1 and 13-2.

The metal band is formed of the same material and has the same characteristics as explained in the conventional embodiment, in that the band is commonly used for measuring tape, of the type that is spring-wound in a casing and when paid out, the tape is relatively rigid (due to transverse sectional shape).

Figure 3:
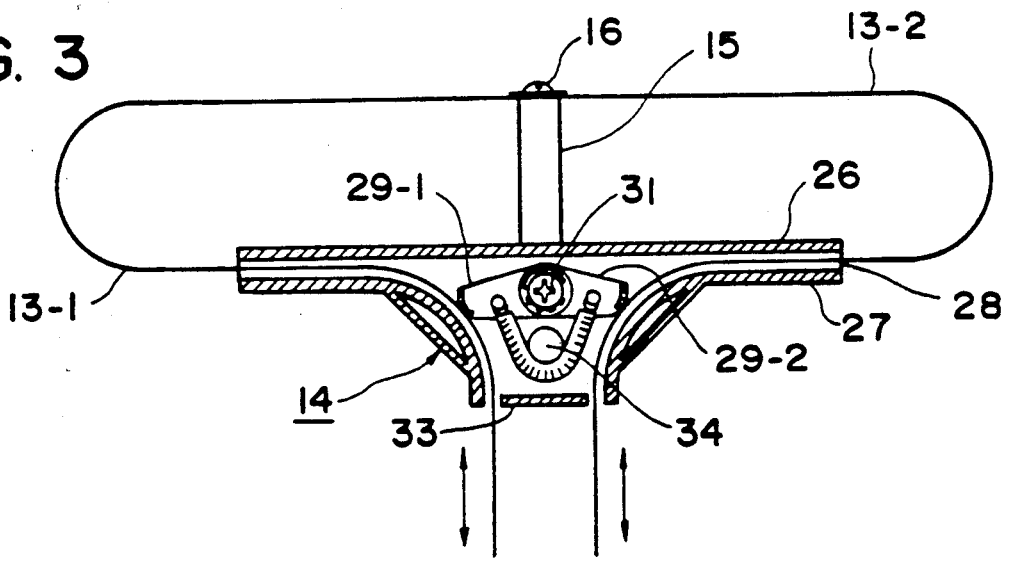
FIG. 3 is a cross-sectional view showing a T-guide used in the FIG. 1 embodiment.
Figure 4:
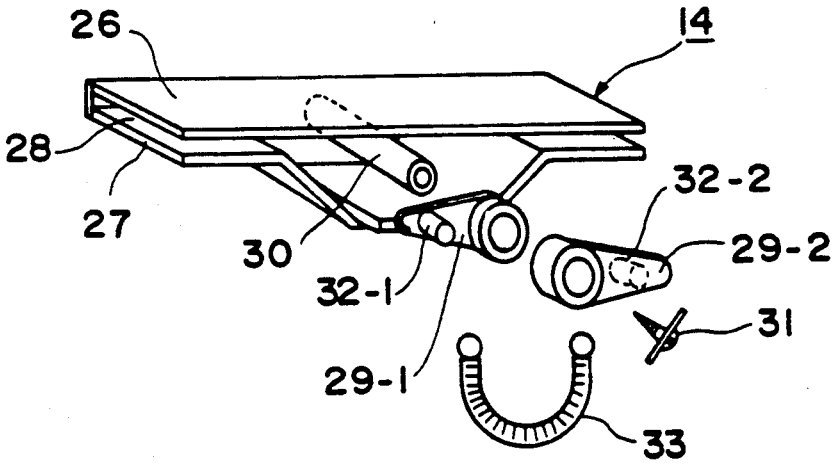
FIG. 4 is an exploded view of the T-guide of FIG. 3.

FIG. 3 is a sectional view showing the T-guide, and FIG. 4 is an exploded view showing its inner portion. As shown in the drawings, a space 28 for allowing the metal band portions 13-1 and 13-2 to be passed therethrough is formed between a flat upper plate 26 and a curved lower plate 27. Each metal band portion is bent in this space to pass through the base side.

Numeral 29-1 and 29-2 are antenna stoppers pivotally provided on a shaft 30 and held thereon by means of a screw 31. Each antenna stopper has an arm formed with projections 32-1 and 32-2 engaged with a spring 33. A projection 34 provided intermediate of the spring provides a force by extending, thereby each antenna stopper 29-1 and 29-2 is biased downwardly. Therefore, the metal band passed through the T-guide 14 is pressed against the inner surface of the curved plate 27.

Figure 5:
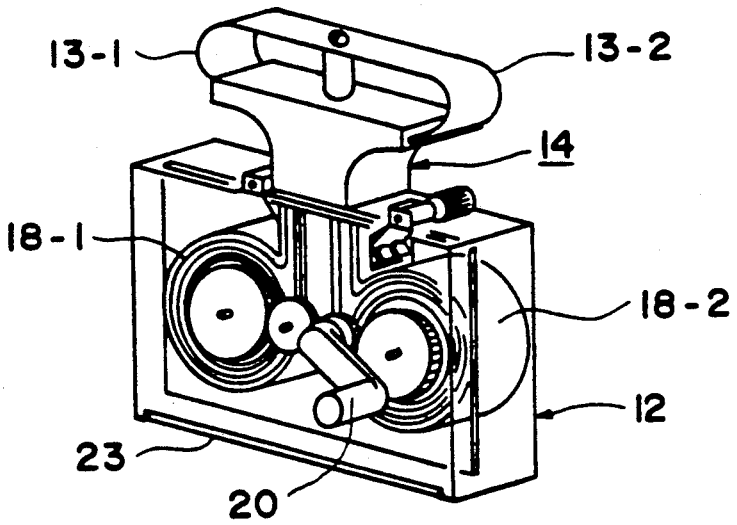
FIG. 5 is a perspective view of the FIG. 1 embodiment, with the antenna element in a retracted position.

FIG. 5 shows the condition when the antenna is out of use and is wound into the base. For setting the antenna, the base is held by one hand and the T-guide 14 is pulled up in the arrow direction "A" by the other hand, thus causing the band to be paid out at the vertical height of the antenna is increased. Then, the metal band portions 13-1 and 13-2 wound around drums 17-1 and 17-2 is paid out by cranking the crank 20 as the horizontal width of the antenna is increased. Thus, tuning is carried out by moving the band in the T-guide 14 to adjust to the received wavelength of radio wave. When the length of horizontal element is formed longer, the vertical portion can be formed shorter. When the vertical portion is required to be shorter, it can be wound by the wind handle 20. When the tuning is obtained most sufficiently, the stable plate 23 can be pulled out by rotating from the base 12 to be set.

For storing the antenna, when the handle 20 is rotated in clockwise direction, the vertical portion of the metal band is first wound, then the bottom portion of T-guide contacts with the base. Further, the metal band portions 13-1 and 13-2 are pulled through T-guide by sliding with further winding. Then, the length of horizontal element is shortened to complete the winding. This action is shown in FIG. 5.

As described above, since the vertical portion of metal band can be shortened by the present invention, the electric characteristics can be improved and more stable antenna device can be provided.

Figure 6:
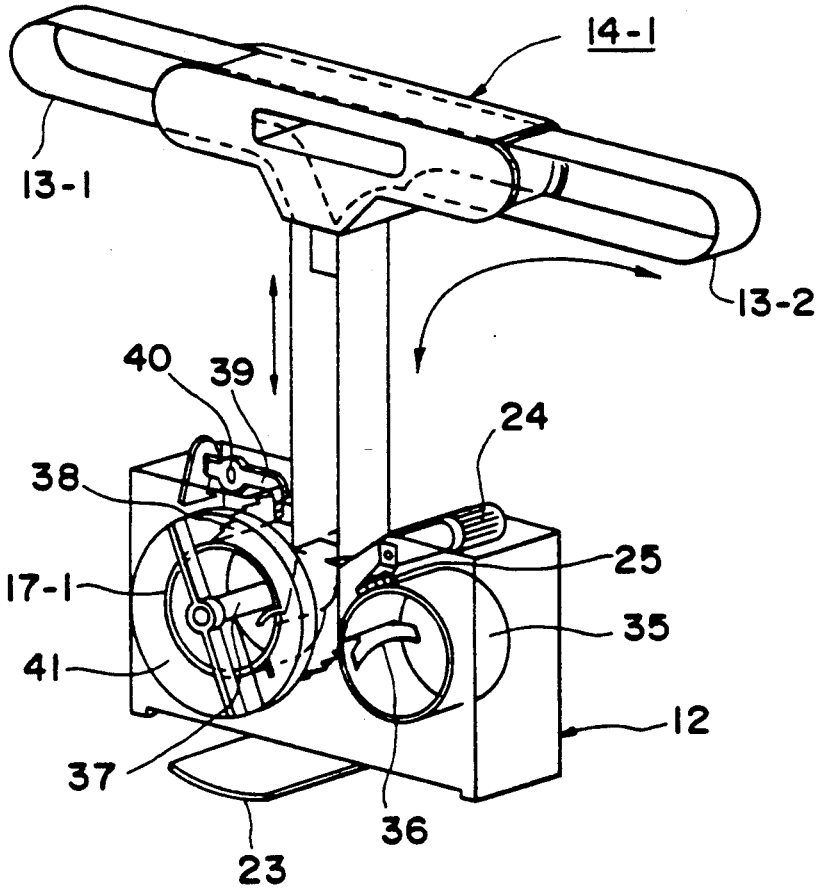
FIG. 6 is a perspective view of a second preferred embodiment of the present invention.
Figure 7:
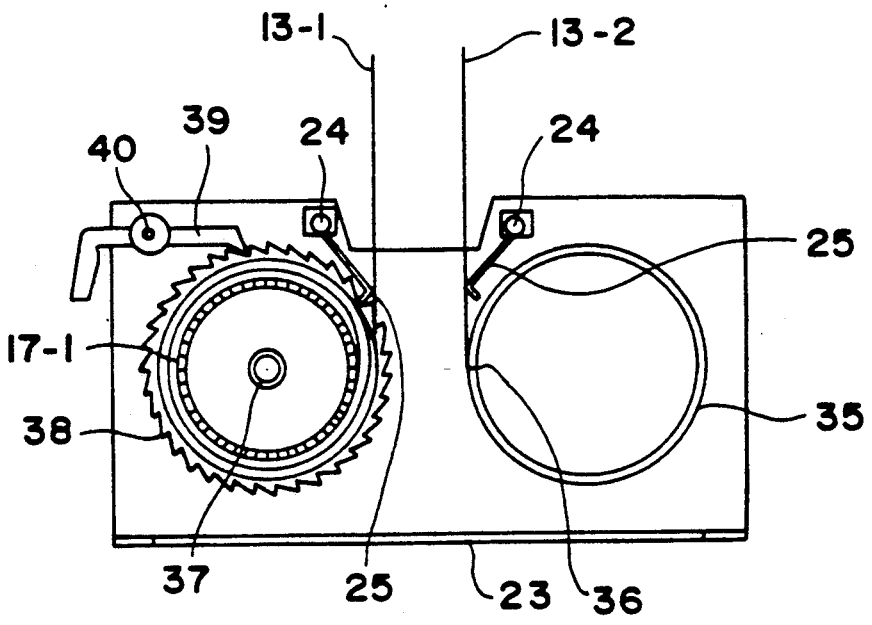
FIG. 7 is a side elevational view showing the main porion of the winding mechanism.

FIG. 6 is a perspective view showing another embodiment of the present invention. FIG. 7 is a side view showing the main portion of winding mechanism.

In this embodiment, only one end portion of the band is fixed, and the other end portion is wound on the drum. In FIG. 6, the same portions as shown in FIG. 1 are given the same reference numerals to obviate explanation.

Numeral 35 is a fixed drum, and one end portion 36 of the metal band 13-2 is fixed to a certain portion thereof. The metal band rising from the end portion 36 is passed through the T-guide 14-1 and passed on the T-guide 14-1 on turning at a certain position on the right side. Further, it is inserted into the T-guide 14-1 on turning the metal band 13-1, and is fixed to a certain position on the rotatable drum 17-1 by passing through downwardly.

A shaft 37 is passed through the center of the drum 17-1 and fixed to a ratchet 38 formed on the circumference of drum 17-1. In short, the drum 17-1 and the ratchet 38 are formed integrally, and the shaft 37 is fixed in the center of the ratchet 38. Therefore, when the shaft 37 is rotated, the ratchet 38 rotates, then the drum 17-1 rotates simultaneously to wind up the metal band 13-1. Numeral 39 is a pawl for releasing an engagement with the ratchet on centering the shaft 40. A dial 41 for winding up is fixed with the shaft 37, the metal band 13-1 being wound up by the rotation of the dial.

Figure 8:
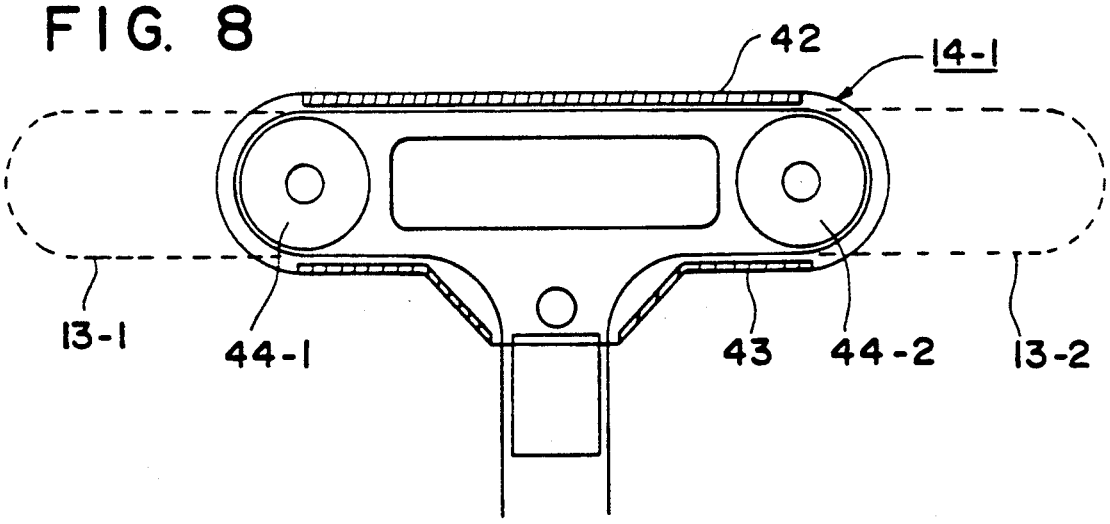
FIG. 8 is a cross-sectional view of a T-guide used in the embodiment of FIG. 6.

FIG. 8 is a sectional view showing the T-guide of the second embodiment. Pulleys 44-1 and 44-2 are provided on both ends of an inner portion formed between an upper plate 42 and a lower plate 43. The metal bands 13-1 and 13-2 are inserted through these pulleys.

The basic operation of the FIG. 6 embodiment is similar to the FIG. 1 embodiment.

Figure 9:
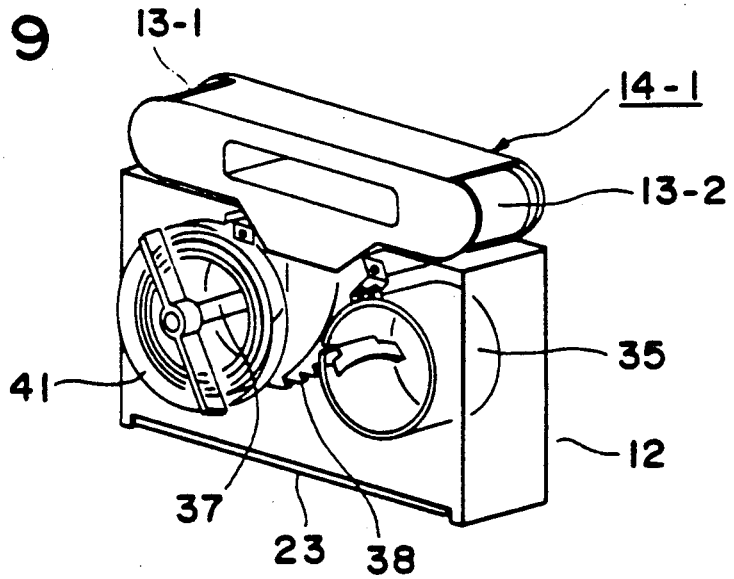
FIG. 9 is a perspective view of the embodiment of FIG. 6 with the antenna element in a retracted position.
Figure 10:
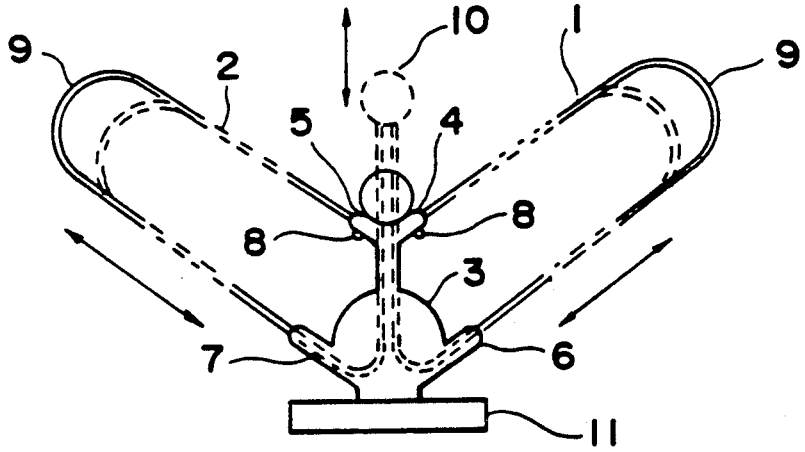
FIG. 10 (Prior Art)
FIG. 10 is a side elevational view of a known antenna device.

FIG. 9 is a view showing the condition which the metal band is wound in the base when the antenna it is out of use.

For setting the antenna, the base and the T-guide are held and the T-guide is pulled up as in the example described above. In this case, one end portion of the metal band 13-2 is fixed to the drum 35, and the drum 35 is also fixed. When the T-guide 14-1 is pulled up, the metal band 13-2 is extended on fixing and the metal band 13-1 is extended for compensating the extended portion of metal band 13-2. When the action for extending the metal band is proceeded, the engagement between the ratchet stopper 39 and the ratchet 38 is to be released. The necessity of the pawl 39 is as follows.

When the dial 41 for winding up is rotated for storing the metal band, the metal band is wound around the drum 17-1. However, the metal band tends to move in a direction of deployment, due to its resiliency. Therefore, the dial is necessary for avoiding the drum to be rotated by its own resiliency.

When the T-guide 14-1 is pulled up, the T-guide has no excess of the metal band on its both sides. Therefore, the horizontal elements are formed on both sides of the T-guide when the length of vertical portion of the metal band is positioned at a certain position. This operation can be carried out by pulling out the left and right side metal band to hold the T-guide downwardly.

As described above, by the present example, an antenna with electrical characteristics and the physical characteristics as in the first example can be provided.

Further, in each example described above, the handle or the dial is used for winding up the metal band. However, the present invention is not limited to these parts; for example, a micro motor can be used in the place of the handle, and its position can be in the fixed drum.

As described above, the present invention provides an antenna device provided with the metal band as an antenna element having an arcuate section, rising up and supporting itself on keeping a straight disposition in the normal condition and bending when its section becomes planar, and returning to its arcuate section when a bending stress is moved, which metal band has a proper amount of flexibility and rigidity and is capable of being wound up in the base. By the present invention, the length of the vertical portion can be adjusted on tuning, therefore, a trap can be avoided. Further, the present invention provides the antenna device in which the stability can be kept by lowering the center of gravity.

In both embodiments, the metal band 13 has an arcuate sectional view, as shown in FIG. 1(*a*). This shape allows the thin metal band to deploy in a straight, rigid fashion, in a manner well known to those who have used measuring tape that employ the metal band. When a bending moment is applied to the band, the arcuate sectional shape flattens out to be substantially planar (so that FIG. 1(*a*) would become a straight line) wherein the band doubles back to form two straight portions and a curved end portion connecting the straight portion.

Both embodiments of the present invention have both opposite ends of the band disposed within the base 12. A portion of the band extends outwardly from the base to form a loop. The loop is expandable and contractible depending on the action of the take-up reels described herein. When the take-up reels are used to pay out a length of the metal band, the horizontal and vertical segments of the loop (formed by the T-guide) can be increased or decreased in length.

Numerous modifications and adaptations of the present invention will apparent to those so skilled in the art and thus, it is intended by the following claims to cover all such modifications and adaptations which fall within the true spirit and scope of the invention.

What is claimed is:

1. An antenna device comprising:

a base;

a metal band having two opposite ends disposed within the base and having a substantially vertical portion upstanding from the base and a substantially horizontal portion formed on top of the substantially vertical portion;

a reel disposed within the base and having one end of the band connected thereto for winding the band thereon; and a guide carried by and slidably receiving the band at a junction between the substantially horizontal and vertical portions, a length of the horizontal portion and a height of the vertical portion of the band being varied in accordance with winding and unwinding the reel.

2. An antenna device as claimed in claim 1, further comprising a second reel disposed within the base and having the end of the band opposite the one end of the band connected thereto for winding the band thereon.

3. An antenna device according to claim 2, further comprising drive means connected to the first and second reels for simultaneously taking up and letting out the band from the first and second reels.

4. An antenna device according to claim 3, wherein the drive means includes a drive gear meshing with the first reel, an idler gear meshing with the second reel and a handle coupled to the drive gear for rotating the drive gear and thus the first and second reels. second reel and a handle coupled to the drive gear for rotating the drive gear and thus the first and second reels.

5. An antenna device according to claim 4, wherein the guide comprises a T-shaped guide having a lower end into which two segments of the band corresponding to the first and second reels are fed and an upper end from which the band emanates from opposite sides thereof, and a vertical support fixedly connected to the upper end of the T-shaped guide and having the band fixedly connected thereto.

6. An antenna device according to claim 5, wherein the T-shaped guide includes stop means disposed in the lower end of the T-shaped guide for holding the band in a horizontally adjusted position.

7. An antenna device according to claim 6, wherein the stop means comprises a pair of pivotally mounted arms each having a projection for receiving an end of a spring, wherein the spring is looped around an anchor for developing a spring biasing force whereby the pivotal arms engage the band.

8. An antenna device according to claim 1, wherein the metal band has an arcuate cross-sectional shape.

9. An antenna device according to claim 1, wherein the base is a rectangular box having a bottom, and includes a pivotally mounted plate disposed in the bottom as a stabilizer.

10. An antenna device according to claim 1, wherein the end of the band opposite the one end of the band is fixedly connected within the base, and wherein the guide comprises a T-shaped guide having a lower portion into which are fed two portions of the band, and an upper portion from which two segments of the band extend radially outwardly from opposite sides thereof.

11. An antenna device according to claim 10, wherein the reel includes a ratchet mechanism for preventing rotation of the reel once the band is taken up on the reel.

12. An antenna device comprising:

a base;

first and second reels rotatably supported in the base and being operatively connected to each other to rotate in opposite directions;

a metal band having first and second opposite ends respectively connected to the first and second reels, and having a substantially vertical portion including left and right vertical supports upstanding from the base and a substantially horizontal portion including a left loop having upper and lower runs, the lower run being formed with the left vertical support, and a right loop having upper and lower runs, the lower run of the right loop being contiguously formed with the right vertical support, the upper runs of the left and right loops forming a common linear segment;

a guide slidably receiving the lower runs at the left and right loops and being fixedly connected to the common linear section so that as the band is wound and unwound, a length of the left and right loops is simultaneously lengthened and shortened; and stop means disposed in the guide for selectively stopping sliding motion of the band relative to the guide during winding and unwinding of the first and second reels so that as the band is wound and unwound the left and right vertical supports are simultaneously lengthened and shortened.

13. An antenna device according to claim 12, wherein the guide has a T-shaped body.

14. An antenna device comprising:

a base;

a reel rotatably supported in the base;

a metal band having the first and second opposite ends, the first end being connected to the reel and the second end being fixedly connected to the base, and having a substantially vertical portion including left and right vertical supports upstanding from the base and a substantially horizontal portion including a left loop having upper and lower runs, the lower run being contiguously formed with the left vertical support, and a right loop having upper and lower runs, the lower run of the right loop being contiguously formed with the right vertical support, the upper runs of the left and right loops forming a common linear segment, a length of the left and right loops and a height of the left and right vertical supports being determined by a selected vertical position of the guide.

* * * * *

UNITED STATES PATENT AND TRADEMARK OFFICE

CERTIFICATE OF CORRECTION

PATENT NO. : 5,101,214

DATED : March 31, 1992

INVENTOR(S) : Sohzo Ohtsuka, Yasushi Matsuyama, Kazuki Hosoya

It is certified that error appears in the above-indentified patent and that said Letters Patent is hereby corrected as shown below:

On the title page, Item [56] under "FOREIGN PATENT DOCUMENTS" insert --39-25826 11/1939 Japan--.

Col. 5, line 62, (claim 4), line 62, delete "second reel and";
line 63, delete entire line;
line 64, delete entire line.

Signed and Sealed this

Twenty-fourth Day of August, 1993

Bruce Lehman

*Attest:*

BRUCE LEHMAN

*Attesting Officer*

*Commissioner of Patents and Trademarks*